US005615647A

United States Patent [19]

Nielsen

[11] Patent Number: 5,615,647

[45] Date of Patent: Apr. 1, 1997

[54] LATCH ASSEMBLY FOR A VALVE CONTROL SYSTEM

[75] Inventor: Douglas J. Nielsen, Marshall, Mich.

[73] Assignee: Eaton Corporation, Cleveland, Ohio

[21] Appl. No.: 665,273

[22] Filed: Jun. 17, 1996

Related U.S. Application Data

[63] Continuation-in-part of Ser. No. 412,474, Mar. 28, 1995.

[51] Int. Cl.[6] ..... F01L 1/18; F01L 13/00

[52] U.S. Cl. ..... 123/90.16; 123/90.41; 123/90.46; 123/198 F; 74/559

[58] Field of Search ..... 123/90.15, 90.16, 123/90.17, 90.27, 90.32, 90.39, 90.41, 90.42, 90.43, 90.44, 90.46, 198 F; 74/519, 559

[56] References Cited

U.S. PATENT DOCUMENTS

| | | | |
|---|---|---|---|
| 4,151,817 | 5/1979 | Mueller | 123/90.16 |
| 4,203,397 | 5/1980 | Soeters, Jr. | 123/90.16 |
| 4,844,023 | 7/1989 | Konno et al. | 123/90.16 |
| 5,297,516 | 3/1994 | Hara | 123/90.16 |
| 5,413,071 | 5/1995 | Paul et al. | 123/90.16 |
| 5,463,988 | 11/1995 | Paul | 123/90.16 |
| 5,544,626 | 8/1996 | Diggs et al. | 123/90.16 |

*Primary Examiner*—Weilun Lo
*Attorney, Agent, or Firm*—Frank M. Sajovec

[57] ABSTRACT

A latch assembly for an engine valve control system wherein first and second rocker arms are selectively latched together to rotate in unison to open the valve in response to the force applied by a cam, or are allowed to rotate independently of one another. The latch assembly includes a slide assembly which is received in surrounding relation to one of the rocker arms and which retains a latch member engageable by the rocker arms. In a preferred embodiment the slide assembly includes a force application surface located along the longitudinal axes of the rocker arms remote from the latch member.

6 Claims, 2 Drawing Sheets

LATCH ASSEMBLY FOR A VALVE CONTROL SYSTEM

This application is a continuation-in-part of U.S. Pat. application Ser. No. 08/412,474, filed Mar. 28, 1995.

The present invention relates to a system for varying the operational characteristics of intake or exhaust valves in an internal combustion engine during various operational modes of the engine and more particularly to a latch mechanism for such system.

Variable valve control systems for multiple valve engines wherein the intake and/or exhaust valves can either be selectively actuated and deactuated or actuated at selected lift profiles, are well known in the art.

One known system is shown in U.S. Pat. No. 4,151,817, which discloses a primary rocker arm element engageable with a first cam profile, a secondary rocker arm element engageable with a second cam profile, and means to interconnect or latch the primary and secondary rocker arm elements.

U.S. Pat. application Ser. No. 412,474 discloses a system of the above type which is specifically operable to selectively actuate or deactuate an engine valve and which comprises a latchable rocker arm assembly including an inner rocker arm having a roller which contacts the cam; an outer rocker arm which engages the valve, the inner and outer arms being in nesting relation to one another and in pivotal contact with a pivot point on the cylinder head of the engine, which pivot point can be the output plunger of a stationary lash adjuster; and a latch member which is moveable between one position wherein it interferes with the free movement of the inner and outer arms relative to one another to effectively latch the inner and outer arms together to actuate the valve, and a second position wherein the inner and outer arms are left free to move relative to one another and the valve is not actuated. The assembly further includes a biasing spring acting between the inner and outer arms to bias the inner arm into engagement with the cam and the outer arm into engagement with the valve, the relationship between the inner and outer arms being effective to counteract the plunger spring and hydraulic forces of the lash adjuster to insure that the lash adjuster does not pump up when the rocker arms are in their unlatched condition.

The present invention provides a preferred embodiment of the latch assembly which provides not only the required latching function but which is also arranged relative to the latchable rocker arm assembly to make optimum use of the space available within a typical internal combustion engine head assembly. More specifically, the invention provides a slide assembly which is received in surrounding relation to one of the rocker arms and which retains a latch member engageable by the other rocker arm. The slide assembly is movable in a direction parallel to the longitudinal axis of the rocker arm between a first position wherein it is received between contact surfaces on the rocker arms to cause the rocker arms to move in unison, and a second position wherein it is out of position to be engaged by the other rocker arm and thus allows the rocker arms to move freely relative to one another. In the first position the poppet valve is opened in response to rotation of the camshaft and in the second position the valve remains closed.

In accordance with another aspect of the invention an actuating surface is provided on the slide assembly which permits an actuating force to be applied to the latch member at a point close to the pivot point of the lash adjuster assembly to provide a more uniform distribution of the forces applied to the rocker arm assembly and to provide more design flexibility in the location of the actuating force producing means, e.g. a solenoid within the cylinder head assembly.

Other objects and advantages of the invention will be apparent from the following description when considered in connection with the accompanying drawings, wherein.

Figure 1:
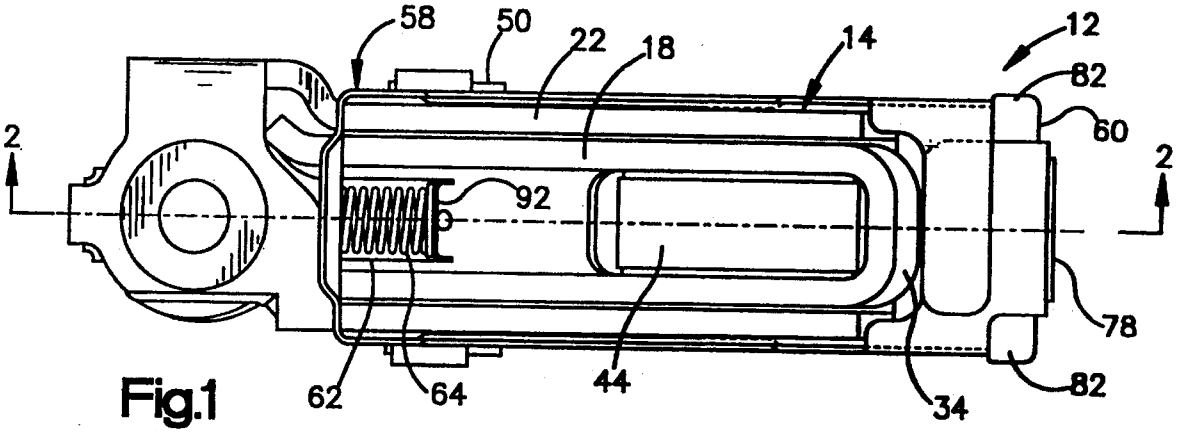
FIG. 1 is a plan view of the invention.
Figure 2:
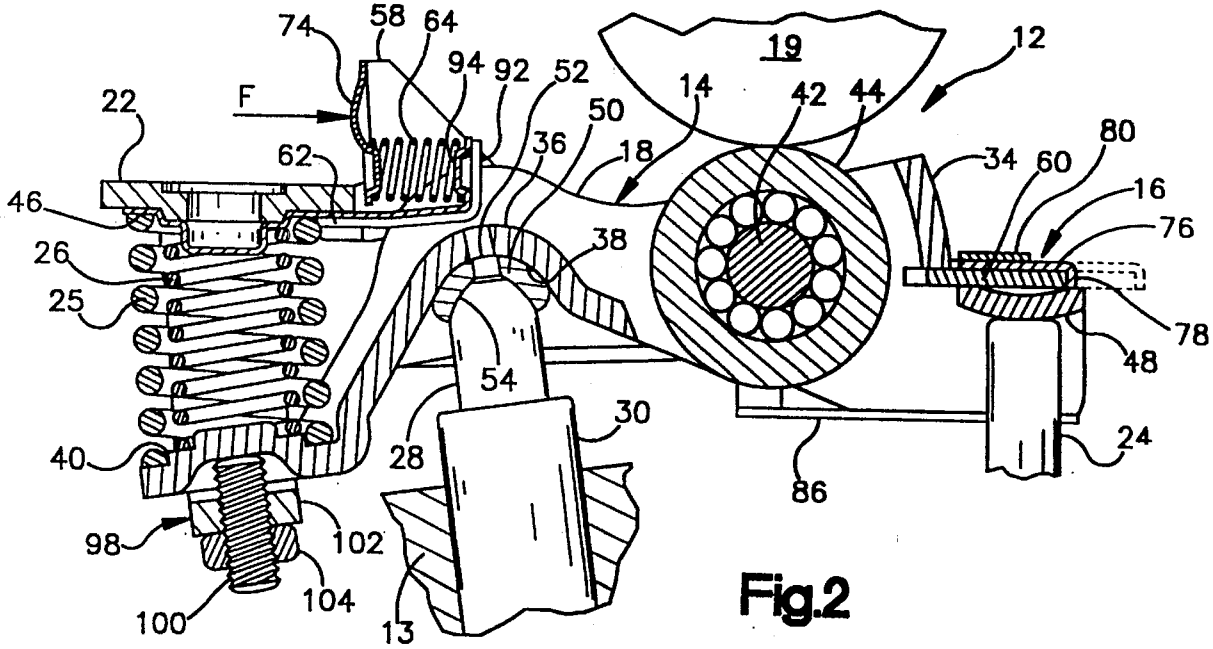
FIG. 2 is a sectional view taken along line 2—2 of FIG. 1.
Figure 3:
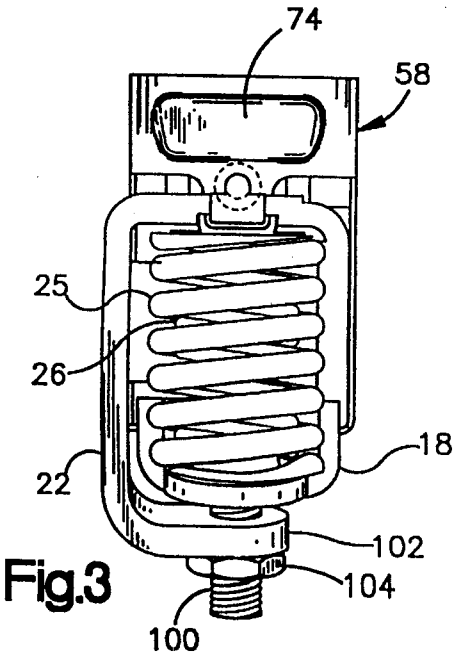
FIG. 3 is an end elevation view of the invention.

Referring primarily to FIGS. 1–3, there is illustrated a valve control assembly 12, of the type disclosed in U.S. patent application Ser. No. 412,474 filed Mar. 28, 1995. As illustrated herein, the control assembly 12 is mounted on the cylinder head 13 of an internal combustion engine and is of the type which is particularly adapted to selectively actuate or deactuate an engine valve, and which comprises a rocker arm assembly 14 which is shiftable between an active mode wherein it is operable to open the valve, and an inactive mode wherein the valve is not opened; and a latch assembly 16 which is operable to shift the rocker arm assembly between its active and inactive modes.

The rocker arm assembly 14 comprises an inner arm assembly 18 which is engageable with the valve actuating cam 19 of the engine, an outer arm 22 which is engageable with a poppet valve 24, and outer and inner biasing springs 25 and 26 respectively which act between the inner and outer arms to bias the inner arm into engagement with the cam and the outer arm into engagement with the plunger 28 of a stationary lash adjuster 30 as well as with the valve 24. In the preferred embodiment of the invention the outer arm 22 is pivotally mounted on the plunger 28 and the inner arm 18 is pivotally mounted on the outer arm 22.

The inner arm 18 is preferably a generally U-shaped stamped structure, having a contact element 34 at the base of the U, and a central spine reaction 36. The spine section 36 defines the pivot point of the arm in the form a concave bearing surface 38 which contacts the outer arm as will be described below, and a spring receiving element 40. Aligned bores are formed in the walls to receive the axle 42 of a needle roller assembly 44. As will be described in more detail below, the contact element 34 defines a latch surface which interacts with the outer arm 2 and the latch assembly 16.

The outer arm 22 is a generally rectangular member in plan view having a first end portion 46 defining a spring receiving element, and a second end portion 48 defining a valve contacting pad.

A pivot bar 50 is received through openings formed in the side walls of the outer arm 22 to define the bearing surface in engagement with the plunger 28 and the inner arm 18. The pivot bar is a rectangular member having an arcuate upper surface 52 (in end view) which defines a pivot surface for the bearing surface 38 of the inner arm, a flat bottom surface, and has a centrally located generally spherical socket 54 which defines a concave bearing surface in engagement with the ball end of the plunger 28. Details of the pivot bar 50 and its function are described in U.S. patent application Ser. No. 575,151, filed Dec. 20, 1995.

When the assembled rocker arms are installed in the engine the socket portion 54 of the pivot bar 50 is positioned over the plunger 28 of the lash adjuster 30, which places the roller assembly 44 of the inner arm 18 in contact with the cam and the contact pad 48 of the outer arm 22 in contact with the valve 24. The springs 25 and 26 are received over the elements 40 and 46 between the inner and outer arms to bias the inner arm 18 into engagement with the cam 13 (via roller 44) and the outer arm 22 into engagement with the valve 24 and the plunger 28.

In accordance with the invention the latch assembly 16 comprises a slide member 58 (see also FIGS. 4–6) which straddles the outer arm 22; a latch member 60 which is retained by the slide member in position to slide along the outer arm between a first position, as shown in solid line in FIG. 2, where it is in position to be engaged by the contact element 34 of the inner arm to effect unitary movement of the inner and outer arms to open the valve 24, and a second position, shown in broken line in FIG. 2, where it is clear of the inner arm, wherein the inner and outer arms are free to move relative to one another and the force of the cam on the roller is not transmitted to the valve; a spring stop 62 attached to the outer arm, and a spring 64 which acts between the stop 62 and the slide member to normally bias the slide member into a position wherein the latch member is engageable by the contact element 34.

Figure 6:
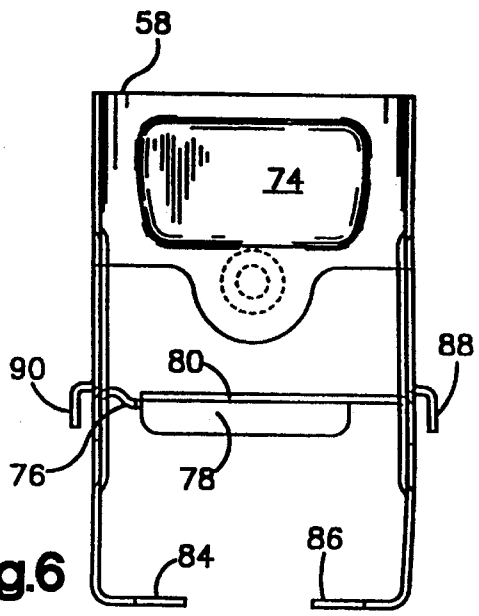
FIG. 6 is an end elevation view of the slide element.
Figure 4:
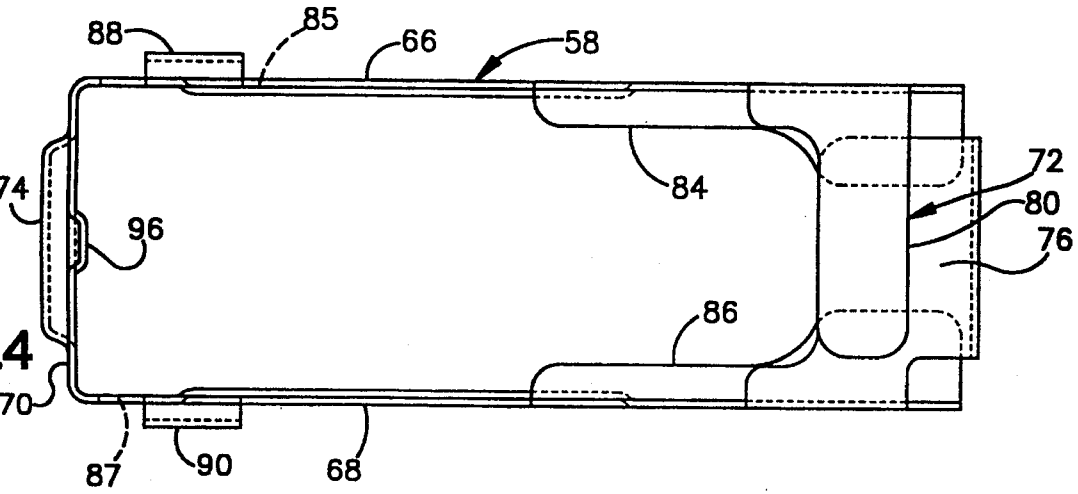
FIG. 4 is a plan view of a slide element of the invention.
Figure 5:
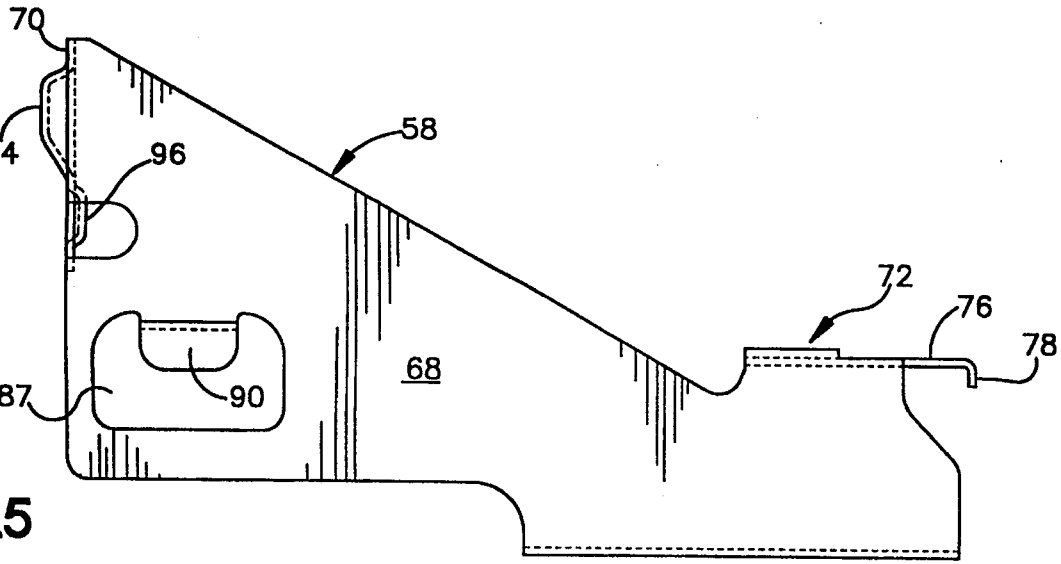
FIG. 5 is a side elevation view of the slide element.

Referring particularly to FIGS. 4–6, the slide member 58 comprises a sheet metal shell which essentially surrounds the outer rocker arm and which comprises side walls 66 and 68 which engage the side walls of the outer rocker arm, an end wall 70, and a latch retaining portion 72. The end wall 70 includes a region 74 which is formed outward to provide a contact surface for the application of a disengaging force represented by the arrow F in FIG. 2, as will be described in more detail below. The latch retaining portion is formed by folding over a first portion 76 of the side wall 68 to overlie the latch member 60, the portion 76 including a downwardly turned tab 78 which retains the latch member axially in one direction, and by folding a second portion 80 over the first portion. The latch member 60 is retained axially in the opposite direction by means of ears 82 formed on the latch member which butt against the right hand edge (as viewed in FIGS. 1 and 2) of the slide member 58. The latch member is independently retained vertically in only one direction by the tabs 76 and 80, since it rests on the surface of the outer rocker arm 22 when the slide member is assembled to the rocker arm assembly. Elongated tabs 84 and 86 fold over the bottom of the outer rocker arm to maintain the slide member 58 in sliding relation to the outer rocker arm.

Referring particularly to FIGS. 4–6, elongated slots 85 and 87 are formed in the side walls of the slide member to provide clearance for the pivot bar 50 and to limit axial movement of the slide member. As shown in FIG. 1, the pivot bar extends beyond the side walls 66 and 68 of the slide mechanism, and as shown in FIGS. 4–6, tabs 88 and 90 are formed above the slots to retain the pivot bar laterally.

As shown in FIG. 2, the spring stop 62 is a formed sheet metal member which is retained by inserting it between the springs 25 and 26 and the spring receiving surface formed at the end 46 of the outer rocker arm. The stop member extends toward the other end of the outer rocker arm and has a tab 92 formed thereon which includes a domed projection 94 to retain the spring 64. Referring also to FIGS. 4 and 5, the slide member 58 has a similar domed projection 96 formed thereon adjacent the contact surface 74. The spring 64 is received between the projections 94 and 96 and biases the slide member 58 to the left relative to the outer rocker arm as viewed in FIG. 2, to maintain the latch member 60 in its normally engaged position, as shown in full line in FIG. 2 between the contact element 34 of the inner rocker arm and the outer rocker arm, wherein the force of the cam 13 acting against the roller bearing assembly 44 is transmitted to the valve 24. When it is desired to deactivate the valve 24, a Force F is applied to the slide member, moving it to the right as viewed in FIG. 2 and moving the latch member 60 out of engagement with the inner rocker arm, wherein the cam force is no longer transmitted to the valve.

In the preferred embodiment illustrated herein the rocker arm assembly includes an adjusting assembly 98 which permits the precise setting of the maximum clearance between the contact element 34 and the latch member 60. The adjusting assembly comprises a screw 100 which is threaded through a portion 102 of the outer arm 22 which extends beneath the inner arm and bears against it. A locknut 104 maintains the adjusted position of the screw.

The actuating force F can be applied by any one of a number of actuating means, including that disclosed in U.S. patent application Ser. No. 540,280 filed Oct. 6, 1995, which is incorporated herein by reference.

I claim:

1. A valve control system for an internal combustion engine including a cylinder head, a poppet valve, and a valve actuating cam; said control system comprising a first rocker arm pivotally mounted on said cylinder head and engageable with said poppet valve; a second rocker arm pivotally mounted in relation to said first rocker arm and engageable with said cam; and means for selectively interconnecting said first and second rocker arms for rotation in unison in response to a force applied by said cam to said second rocker arm comprising a plate member movable relative to said first and second rocker arms between a first position wherein said plate member interferes with relative rotation between said first and second rocker arms and a second position permitting relative rotation between said first and second rocker arms; characterized by said means for selectively interconnecting said first and second rocker arms further comprising a housing slidingly received on one of said rocker arms, and means formed on said housing for retaining said plate member in sliding relation to said one rocker arm.

2. Apparatus as claimed in claim 1, in which said first rocker arm is defined by spaced apart side walls and said second rocker arm is received between said side walls, said housing being received on said first rocker arm, and said apparatus further including biasing means acting between said housing and said first rocker arm to bias said plate member into said first position.

3. Apparatus as claimed in claim 1, including means acting between said first and second rocker arms biasing said first rocker arm into engagement with said poppet valve and said second rocker arm into engagement with said cam.

4. Apparatus as claimed in claim 3, including a hydraulic lash adjuster having an output member extending therefrom mounted on said cylinder head, said first and second rocker arms being pivotal about axes perpendicular to and intersecting the longitudinal axis of said output member.

5. Apparatus as claimed in claim any one of claims 1 through 4, in which said housing includes a force application surface formed thereon, said force application surface being formed adjacent the pivot axes of said first and second rocker arms.

6. Apparatus as claimed in claim 5, including a first surface engageable with said plate member formed on said first rocker arm, a second surface engageable with said plate member formed on said second rocker arm, and cam follower means on said second rocker arm engageable with said valve actuating cam; wherein said cam follower means, said first and second surfaces and the pivot axes of said first and second rocker arms are distributed along a line parallel to the longitudinal axes of said first and second rocker arms with said cam follower means being located between said first and second surfaces and said pivot axes along said line; said force application surface being located outside said pivot axes in relation to said cam follower means and said first and second surfaces.

* * * * *